United States Patent [19]

Taylor et al.

[11] Patent Number: 4,734,077

[45] Date of Patent: Mar. 29, 1988

[54] SELF POWERED TOY VEHICLE WITH AUXILIARY TRANSMISSION FOR OPERATING ANCILLARY DEVICE

[76] Inventors: Christopher J. C. Taylor, 55 Crescent Lane, London SW4 9PT; Christopher C. Wiggs, 64 Goldsborough Crescent, Chingford, London E4, both of United Kingdom

[21] Appl. No.: 741,210

[22] Filed: Jun. 5, 1985

[30] Foreign Application Priority Data

Jun. 5, 1984 [GB] United Kingdom ..... 8414242

[51] Int. Cl.[4] ..... A63H 29/22

[52] U.S. Cl. ..... 446/462

[58] Field of Search ..... 446/462, 463, 424, 427, 446/428, 433, 434, 460, 443, 436, 437, 448

[56] References Cited

U.S. PATENT DOCUMENTS 2,782,730 2/1957 Frank ..... 446/467 X 4,306,375 12/1981 Goldfarb et al. ..... 446/462 X 4,504,239 3/1985 Kulesza et al. ..... 446/462 X 4,545,776 10/1985 Law ..... 446/460 X

*Primary Examiner*—Mickey Yu

*Attorney, Agent, or Firm*—Lowe, Price, LeBlanc, Becker & Shur

[57] ABSTRACT

A power take-off is provided for a model vehicle driven from a single "penlight" battery. The vehicle has a chassis (10) carrying an electric motor driving an axle (5) through a horiozntal worm (4) and worm gear. A cover (11) for the motor has a through hole for a shaft (12) carrying a lower pinion (13) engaged with the worm (9) and an upper pinion (14) that drives a take-off gear (15) provided with dog-clutch pins (16). A sliding gear (26) provides the second part (27) of the dog clutch and drives actuator cranks (37) of an output shaft (35). Thereby anciliary devices of the vehicle may be driven from the same motor that drives the wheels.

4 Claims, 2 Drawing Figures

SELF POWERED TOY VEHICLE WITH AUXILIARY TRANSMISSION FOR OPERATING ANCILLARY DEVICE

FIELD OF THE INVENTION

This invention relates to a model vehicle.

BACKGROUND TO THE INVENTION

A model vehicle driven by a single "penlight" battery is described in U.S. Pat. No. 4,306,375 (Goldfarb), and it is an object of the invention to enable model vehicles of this general kind to have anciliary devices power operated from the motor.

SUMMARY OF THE INVENTION

The vehicle of the invention therefore has a chassis provided with power take-off means coupled to the anciliary device through a transmission that is separate from the drive transmission.

The invention therefore provides a model vehicle having a chassis carrying an electric motor driving an axle through a horizontal worm and worm gear, a cover for the motor and a power take-off comprising a lower pinion engaged with the worm driving a second pinion on the exposed face of the cover via a shaft passing through the cover.

DESCRIPTION OF PREFERRED FEATURES

Desirably a by-pass motor contact path is provided so that the anciliary device may be operated with the drive to the wheels switched off or in a neutral position.

The motor, wheel drive transmission and batteries are supported in a chassis that need not change throughout the range of the vehicles, and there is a range of snap-on bodies that distinguish one model from another. The power take-off of the invention may be used to operate anciliary devices in the body.

All that is required to be done is to add a pair of pinions and a take-off gear to the transmission that are driven by an existing worm gear of the drive transmission, and to provide a by-pass motor contact path. A body having moving anciliary devices may be driven through a second transmission including actuator cranks operably connected to the anciliary devices. If desired a latching switch can allow the anciliary devices to be operated while the vehicle is travelling.

Other features of the invention are defined in the appended claims to which attention is directed.

BRIEF DESCRIPTION OF DRAWINGS

An embodiment of the invention will now be described with reference to the accompanying drawings, FIG. 1 of which is an exploded view of a vehicle model according to Goldfarb et al U.S. Pat. No. 4,306,375 and FIG. 2 of which is an exploded view of the power take-off arrangement of the invention.

DETAILED DESCRIPTION OF PREFERRED EMBODIMENT

Figure 1:
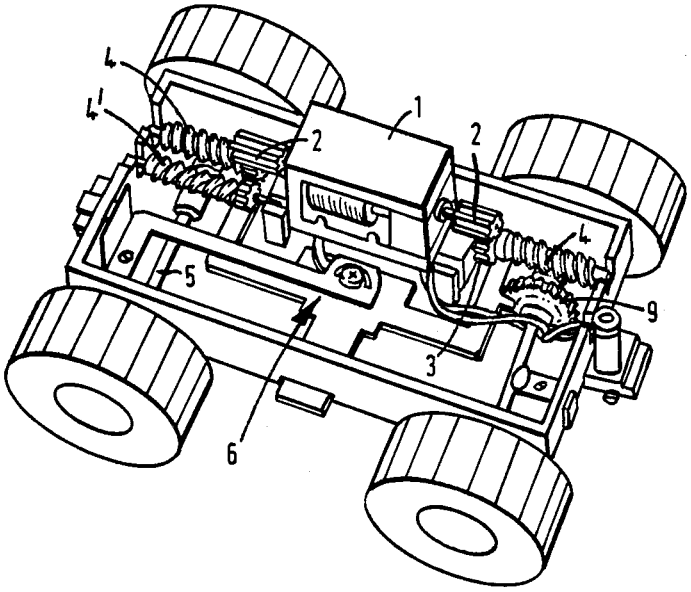
FIG. 1 PRIOR ART
Figure 2:
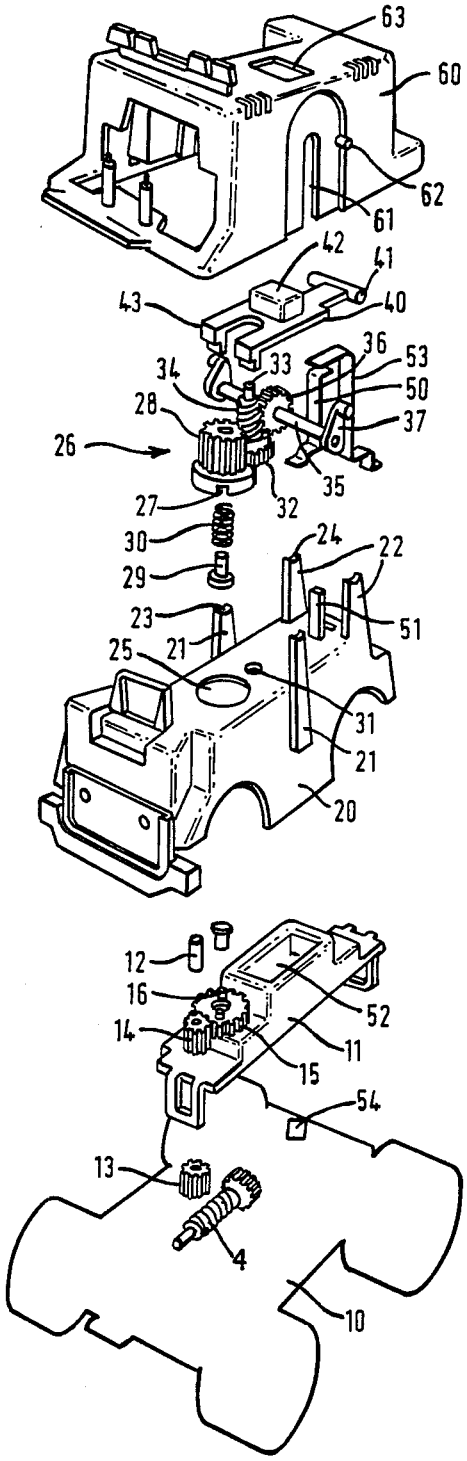

The power take-off arrangement of the invention is intended to fit onto the chassis of a toy or model vehicle of the general kind described in Goldfarb et al U.S. Pat. No. 4,306,375. In that chassis a four wheel drive is provided by means of a small electric motor 1 having a double-ended shaft and a symmetrical gearing system. At each end of the motor a pinion 2 is fixed to the shaft that meshes with a spur gear 3 which drives a worm 4. The worm 4 in turn drives a gear 9 rotatably fixed to a corresponding axle 5 of the vehicle. The motor 1, pinions 2, spur gear 3 and worms 4 are aligned along one side wall inside a vehicle chassis moulding 10 with a battery compartment 6 alongside them occupying the rest of the chassis 10. A gearbox cover 11 (FIG. 2) is a push fit over the motor 1 and drive train.

In model vehicles according to the Goldfarb patent as currently being sold there are two parallel worms 4, 4', one driven from the other at each end of the vehicle, and the worms are slideable under the control of a selector fork to engage one or the other of the worms 4 to provide a high or low speed drive or to provide a neutral position in which neither worm 4 is engaged and the model can be moved without the motor 1 being energised.

This invention is based on the realisation that if one of the worms 4' is removed at one end of the vehicle, the other can be engaged by a pinion to provide a vertical power take-off that can be used to power moving devices in the body of the vehicle. Thus in FIG. 2 the chassis 10 has a battery cover 11 formed with a hole that journals a spindle 12 that carries upper and lower pinions 13, 14. The lower pinion 13 meshes with a worm 4 in the chassis 10 and the upper pinion 14 drives an intermediate gear 15 provided on its top face with teeth 16 of a dog clutch.

Onto the chassis 10 there fits an underbody 20 provided to each side with front posts 21 and rear posts 22 formed in their top faces with arcuate bearings 23, 24. The underbody 20 is apertured at 25 to receive a second intermediate gear 26 having sockets 27 in its lower face defining the second part of the dog clutch and a pinion 28. The pinion slides on vertical shaft 29 and is normally urged upwards out of engagement with the intermediate gear 15 by a coil spring 30. The underbody supports at 31 a layshaft 33 carrying a worm 34 and a pinion 32 that is driven by the pinion 28. An output shaft 35 is carried on the bearings 23 of the front posts 21 and has a drive pinion 36 in mesh with the worm 34 and a pair of crank arms 37 for driving an external device.

An actuator lever 40 has a fulcrum bar 41 that rests in the bearings 24 of posts 22, an actuator button 42 and a pair of forks 43 that engage the top face of the intermediate gear 26. Thus when the button 42 is depressed the intermediate gear 26 is pushed down on the shaft 29 against the resistance of the spring 30 to engage the dog clutch 16, 27 so that power is transmitted from the worm 4 via the pinions 13, 14 and the chassis take-off gear 15 to the sliding gear/clutch 26 and thence to the shaft 35 carrying the actuator cranks 37.

For operation of anciliary devices on the body it is desirable that the motor switch should be by-passed so that the anciliary devices can be operated with the vehicle in neutral and with the drive switch off. For this purpose a motor contact 50 supported by anvil post 51 on the underbody 20 passes through aperture 52 in the cover 11 and makes contact with the casing of the motor which is live. A second contact 53 is connected to chassis motor contact 54 which is connected to the other side of the battery in the chassis 10. Depression of the button 42 makes the contact between contacts 50,53 and powers the motor.

An outer body 60 fits onto the underbody 20 and has side slots 61 through which the extremities of the shaft 35 pass and which serve to locate the shaft 35 onto the bearings 23. In similar manner the bar 41 is retained on the bearings 24. The body 60 has fulcrum pins 62 for the external device to be actuated such as the spade of a bulldozer or the forks of a fork lift truck and it is apertured at 63 for access to the button 42.

We claim:

1. A model vehicle having a chassis carrying an electric motor driving an axle through a horizontal worm and gear, a cover for the motor and a power take-off comprising a lower pinion engaged with the worm driving a second pinion on the exposed face of the cover via a shaft passing through the cover, including a take-off gear rotatably supported on the exposed face of the cover, an end surface of said take-off gear having pins of a dog-clutch, said second pinion driving said take-off gear.

2. A vehicle according to claim 1, wherein a sliding gear clutch operated by selector forks of an actuator lever is engageable against the resistance of a spring with the pins of the dog clutch.

3. A vehicle according to claim 2, wherein the sliding gear clutch drives actuator cranks of an output shaft for actuating anciliary devices of the vehicle.

4. A vehicle according to claim 3, including a first drive switch operable in first and second states to place the motor in drive and neutral positions, respectively, and a second switch engageable with the motor drive switch in its second state to enable drive of the anciliary devices.

* * * * *